United States Patent [19]

Anderson

[11] Patent Number: 4,811,516

[45] Date of Patent: Mar. 14, 1989

[54] BARRIER GATE ARM

[75] Inventor: Howard A. Anderson, Pittsburgh, Pa.

[73] Assignee: Mobay Corporation, Pittsburgh, Pa.

[21] Appl. No.: 102,932

[22] Filed: Sep. 30, 1987

Related U.S. Application Data

[63] Continuation of Ser. No. 914,909, Oct. 3, 1986, abandoned.

[51] Int. Cl.[4] ..... E01F 13/00

[52] U.S. Cl. ..... 49/49; 49/141

[58] Field of Search ..... 49/9, 34, 35, 49, 141, 49/192

[56] References Cited

U.S. PATENT DOCUMENTS

| | | | |
|---|---|---|---|
| 3,295,556 | 1/1967 | Gertsma et al. | 138/119 |
| 3,686,794 | 8/1972 | Sakamoto et al. | 49/49 X |
| 3,791,072 | 2/1974 | Miller | 49/49 X |
| 3,913,264 | 10/1975 | Kohen | 49/49 |
| 4,201,830 | 5/1980 | Wollen | 428/375 |
| 4,232,484 | 11/1980 | Buchmann | 49/49 X |
| 4,364,200 | 12/1982 | Cobb | 49/192 |

FOREIGN PATENT DOCUMENTS

| | | | |
|---|---|---|---|
| 255338 | 6/1960 | Australia . | |
| 3345797 | 6/1985 | Fed. Rep. of Germany | 49/49 |
| 3413163 | 10/1985 | Fed. Rep. of Germany | 49/9 |
| 1044247 | 11/1953 | France . | |
| 1400069 | 4/1965 | France . | |

*Primary Examiner*—Philip C. Kannan

*Attorney, Agent, or Firm*—Gene Harsh; Joseph C. Gil; Aron Preis

[57] ABSTRACT

A barrier gate arm useful in controlling exits such as in parking lots is provided comprising a stiffening member, preferably of wood, encased in an extruded sheath, or sleeve made from polycarbonate. The arm provides for easy operation and for a quick repair after the inevitable damage by offending vehicles.

2 Claims, 1 Drawing Sheet

BARRIER GATE ARM

This application is a continuation of Ser. No. 914,909, filed Oct. 3, 1986, now abandoned.

FIELD OF THE INVENTION

The invention is related to barrier gate arms, more particularly to arms useful in exit control such as in parking lots.

SUMMARY OF THE INVENTION

A barrier gate arm useful in controlling exits such as in parking lots is provided comprising a stiffening member, preferably of wood, encased in an extruded sheath, or sleeve made from polycarbonate. The arm provides for easy operation and for a quick repair after the inevitable damage by offending vehicles.

BACKGROUND OF THE INVENTION

A lateral blocking arm which is mounted to an upright post and forms a parking space barrier is described in U.S. Pat. No. 3,913,264. U.S. Pat. No. 3,295,556 discloses a bendable tubular conduit which may be folded or bent without the walls thereof being permanently deformed. U.S. Pat. No. 4,201,830 discloses an energy absorbing structure having a rod-like lateral cross section in which an inner structural member is made of a material capable of providing rigid structural strength, but being frangible upon sharp impact, and an exterior covering generally surrounding the inner member which, in the event that the inner member breaks, prevents sharp ends of edges of the broken inner member from protruding, and impaling an individual who impacts the structure. Among the suitable material for the structure, structural foam polycarbonate is mentioned for the inner member and polyvinyl chloride is mentioned as the exterior covering. U.S. Pat. No. 4,364,200 discloses a gate apparatus comprising a member which is an elongate tube of plastic material and is movable angularly upward in a disclosed manner. Australian Pat. No. 255,338 discloses a surveyor's pole which is encased throughout its length with plastic tubing or sheathing in standard survey colors. French Pat. No. 1,044,247 and 1,400,069 both disclose covering of wood core or equivalent by a protective sheath, including a plastic sheath.

The invention will be further illustrated by reference to the accompanying drawings.

FIG. 1. shows the gate arm in operation. The gate arm as shown comprises a stiffening core 1, and a polycarbonate sleeve. A gear motor, 3, is used to move the arm.

FIG. 2. shows a cross section of the arm consisting the core, 1, and the sleeve, 2.

FIG. 3 is a detailed representation of the sleeve showing the co-extruded color strip.

DETAILED DESCRIPTION OF THE INVENTION

Figure 1:
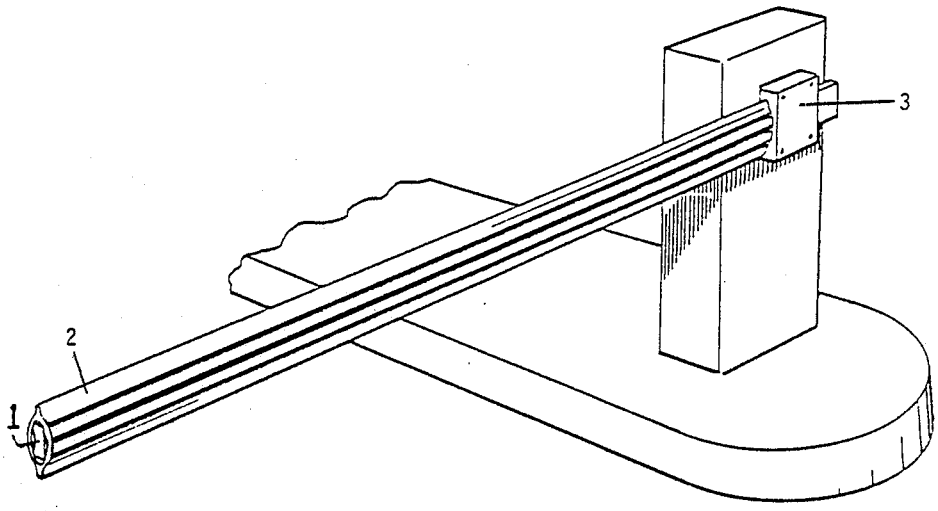
Figure 2:
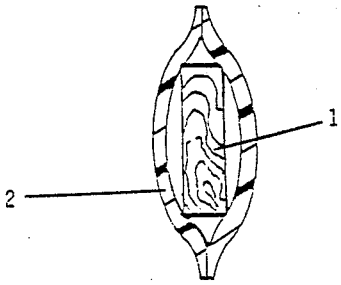
Figure 3:
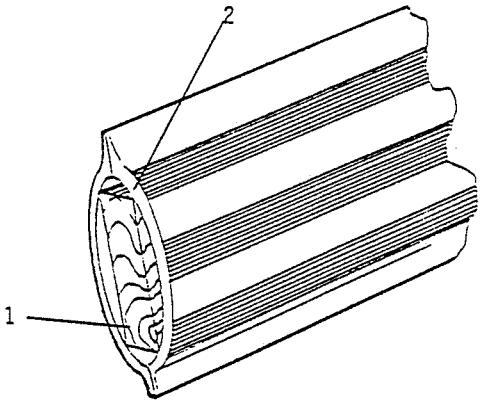

The barrier gate arm of the present invention comprises a stiffening member forming a core, preferably of wood and a sleeve or a sheath, encasing the core. The arm of the invention is advantageously used in parking lot gates and similar installations where an offending vehicle may collide with the arm causing the wooden core to break. The invention permits a quick restoration of the arm to an operating condition.

The stiffening member is suitably of a length sufficient to function as a barrier and its cross section is of the shape and size to fit comfortably in the sheath. Typically the member is 10 to 14 feet long. The sleeve, or sheath, is made of extruded polycarbonate and while its cross sectional shape is not critical it should be sufficiently large to accommodate the stiffening member. The cross section is advantageously elliptical. An advantageous cross section is described in U.S. Pat. No. 3,295,556 which is incorporated by reference herein. An advantage accruing from the novel arm is that the replacement of a broken core is easily and economically achieved without loss of appearance or effectiveness. Also, the light weight of the arm, in comparison with an all-metal arm, is an advantage insofar as the stress on a gear motor which is commonly used to move the arm is reduced. Further, the novel arm is less likely to cause damage to offending vehicles.

The wall thickness of the extruded polycarbonate is not critical as long as the sleeve is self-supporting. Typically, the wall thickness is about 0.030–0.050 inches. The sleeve may be made by extrusion from a polycarbonate resin and may advantageously be extruded in a plurality of colors typical of the colors used in marking controlled excess.

An added advantage of the invention results from that in most gate arms, the clamping of the wooden core is designed to cause the wood to break at the clamp edge upon impact. In the practice of the present invention the wood core may, upon break, be partially withdrawn from the sleeve to provide a fresh clamping area. This may be repeated several times without losing the effectiveness of the arm.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A movable gate arm comprising (i) a stiffening member made from wood, said member being encased within a sleeve made from extruded polycarbonate and (ii) a gear motor, said motor being the means for moving said arm.

2. The arm of claim 1 wherein said sleeve has an elliptical cross section.

* * * * *